US011885351B2

(12) United States Patent
Morgan

(10) Patent No.: US 11,885,351 B2
(45) Date of Patent: Jan. 30, 2024

(54) INLET GUIDE VANE ACTUATOR ASSEMBLY

(71) Applicant: DAIKIN INDUSTRIES, LTD., Osaka (JP)

(72) Inventor: Jeffrey Morgan, Minneapolis, MN (US)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/771,299

(22) PCT Filed: Oct. 9, 2020

(86) PCT No.: PCT/JP2020/038381

§ 371 (c)(1),
(2) Date: Apr. 22, 2022

(87) PCT Pub. No.: WO2021/085092

PCT Pub. Date: May 6, 2021

(65) Prior Publication Data

US 2022/0389937 A1 Dec. 8, 2022

Related U.S. Application Data

(60) Provisional application No. 62/928,881, filed on Oct. 31, 2019.

(51) Int. Cl.

| | |
|---|---|
| ***F04D 29/46*** | (2006.01) |
| ***F04D 17/10*** | (2006.01) |
| ***F04D 29/44*** | (2006.01) |

(52) U.S. Cl.

CPC ..... *F04D 29/462* (2013.01); *F04D 17/10* (2013.01); *F04D 29/444* (2013.01)

(58) Field of Classification Search

CPC ..... F04D 29/462; F04D 29/444; F04D 17/10; F01D 17/162; F05D 2260/53

See application file for complete search history.

(56) References Cited

U.S. PATENT DOCUMENTS 2,874,893 A * 2/1959 Goettl ..... F04D 29/462 415/150
3,362,625 A * 1/1968 Endress ..... F04D 29/462 415/149.1

(Continued)

FOREIGN PATENT DOCUMENTS

JP 59-45298 U 3/1984

OTHER PUBLICATIONS

International Preliminary Report of corresponding PCT Application No. PCT/JP2020/038381 dated May 12, 2022.

(Continued)

*Primary Examiner* — Courtney D Heinle
*Assistant Examiner* — Ryan C Clark
(74) *Attorney, Agent, or Firm* — Global IP Counselors, LLP

(57) ABSTRACT

An inlet guide vane assembly for a centrifugal compressor includes a plurality of guide vanes, a drive structure coupled to the plurality of guide vanes, an actuator; and an actuation mechanism. Rotation of the drive structure is transitions the plurality of guide vanes from a first position to a second position. The actuation mechanism causes the drive structure to transition the plurality of guide vanes between the first and second positions based on operation of the actuator. The actuation mechanism imparts a first amount of rotational force to drive the drive structure when the guide vanes are in the first position, and a second amount of rotational force when the guide vanes are in the second position. The actuation mechanism provides a mechanical advantage to the actuator when the guide vanes are in the first positions as compared to when the guide vanes are in the second position.

15 Claims, 14 Drawing Sheets

(56) References Cited

U.S. PATENT DOCUMENTS

| | | | | |
|---|---|---|---|---|
| 4,890,977 | A * | 1/1990 | Tremaine | F04D 29/4213 415/164 |
| 4,969,798 | A * | 11/1990 | Sakai | F04D 29/4213 415/48 |
| 5,108,256 | A | 4/1992 | Herbst et al. | |
| 8,079,808 | B2 * | 12/2011 | Sconfietti | F04D 29/701 415/206 |
| 9,200,640 | B2 * | 12/2015 | Patil | F04D 29/462 |
| 9,714,662 | B2 * | 7/2017 | Kurihara | F04D 25/0606 |
| 9,739,289 | B2 * | 8/2017 | Oda | F04D 29/4213 |
| 2007/0166149 | A1 * | 7/2007 | Tacconelli | F04D 27/0246 415/160 |
| 2011/0219813 | A1 * | 9/2011 | Kurihara | F04D 27/0246 415/213.1 |
| 2012/0134784 | A1 * | 5/2012 | Yen | F04D 29/4213 415/151 |
| 2015/0125274 | A1 * | 5/2015 | Liang | F04D 29/4213 415/157 |
| 2016/0281736 | A1 * | 9/2016 | Wiederien | F04D 29/462 |
| 2017/0146271 | A1 * | 5/2017 | Hasegawa | F04D 29/582 |
| 2020/0309141 | A1 * | 10/2020 | Vuletic | F04D 29/464 |

OTHER PUBLICATIONS

International Search Report of corresponding PCT Application No. PCT/JP2020/038381 dated Jan. 20, 2021.

* cited by examiner

INLET GUIDE VANE ACTUATOR ASSEMBLY

CROSS-REFERENCE TO RELATED APPLICATIONS

This U.S. National stage application claims priority under 35 U.S.C. § 119(a) to U.S. Provisional Patent Application No. 62/928,991, filed in the United States on Oct. 31, 2019, the entire contents of which are hereby incorporated herein by reference.

BACKGROUND

Technical Field

This application claims priority to U.S. Provisional Application No. 62/928,881 filed on Oct. 31, 2019, the entirety of which is hereby incorporated by reference in its entirety.

This invention relates generally to inlet guide vanes and, in particular, to actuator assemblies for opening and/or closing inlet guide vanes in heating, ventilation, air conditioning and refrigeration equipment.

Background Art

This section is intended to introduce the reader to various aspects of the art that may be related to various aspects of the presently described embodiments, to help facilitate a better understanding of various aspects of the present embodiments. Accordingly, it should be understood that these statements are to be read in this light, and not as admissions of prior art.

Modern residential and industrial customers expect indoor spaces to be climate controlled. In general, heating, ventilation, and air-conditioning ("HVAC") systems circulate an indoor space's air over low-temperature (for cooling) or high-temperature (for heating) sources, thereby adjusting the indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

In a typical residential system, a fluid refrigerant circulates through a closed loop of tubing that uses compressors and other flow-control devices to manipulate the refrigerant's flow and pressure, causing the refrigerant to cycle between the liquid and gas phases. These phase transitions generally occur within the HVAC's heat exchangers, which are part of the closed loop and designed to transfer heat between the circulating refrigerant and flowing ambient air. This is the foundation of the refrigeration cycle. The heat exchanger where the refrigerant transitions from a gas to a liquid is called the "condenser," and the condensing fluid releases heat to the surrounding environment. The heat exchanger where the refrigerant transitions from liquid to gas is called the "evaporator," and the evaporating refrigerant absorbs heat from the surrounding environment.

For commercial applications, centrifugal chillers are an economical way to control the indoor climate of large buildings. Within a typical chiller system, multiple fluid loops cooperate to transfer heat from one location to another. At the core of a typical chiller is the refrigerant loop that circulates a fluid refrigerant transitioning between liquid and gaseous phases, to effect the desired absorption or release of heat. This is similar to traditional residential systems. But instead of the refrigerant transferring or absorbing heat directly to or from the surrounding or circulating air, chillers often employ loops of circulating water to which or from which heat is transferred. To cool the building, the refrigerant loop's evaporator may be designed to absorb heat from water circulating in a chilled-water loop that, in turn, absorbs heat from the indoor environment via a heat exchanger in an air-handling unit. And the refrigerant loop's condenser may be designed to release heat from the circulating refrigerant to water circulating in a cooling-water loop that, in turn, releases heat to the outdoor environment via a heat exchanger in a cooling tower.

The circulation of the refrigerant within the refrigerant loop can be, in part, driven by a centrifugal compressor, which has inlet guide vanes (IGVs) that open and close to vary the flow of refrigerant into the compressor and thereby regulate the chiller's cooling capacity. As the inlet guide vanes start to close, they change the entry angle to the impeller and reduce the rate of flow and chiller's cooling capacity. In some applications, gaseous refrigerant impacting the guide vane may produce a torque that resists movement of the IGVs from a more closed position to a more open position. Often this resistive torque is highest when the IGVs are in or very close to the closed position, and it may decrease as the IGVs transition to the open position.

To overcome the maximum resistive torque, more powerful actuators may be utilized. However, these more powerful actuators are typically larger, more costly, and require more energy to operate.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to a heating, ventilation, air conditioning or refrigeration (HVACR) system utilizing a centrifugal compressor with an inlet guide vane actuator assembly for opening and/or closing the IGVs.

In some embodiments, IGVs are coupled to an assembly that utilizes a worm drive and linkage components arranged to create a mechanical advantage. In some embodiments, the IGV actuator assembly includes a plurality of guide vanes; a drive structure coupled to the plurality of guide vanes wherein rotation of the drive structure transitions the plurality of guide vanes from a first position to a second position; an actuator; an actuation mechanism configured to transition the plurality of guide vanes between the first and second positions based on operation of the actuator, wherein the actuation mechanism imparts a first amount of rotational force to drive the drive structure when the guide vanes are in the first position and a second amount of rotational force when the guide vanes are in the second position, and wherein the actuation mechanism provides a mechanical advantage to the actuator when the guide vanes are in the first positions as compared to when the guide vanes are in the second position.

In some embodiments, the mechanical advantage increases the force applied to a drive ring and/or the IGVs when the IGVs are in a substantially closed position. In some embodiments, the less actuator torque is required when the IGVs are in a substantially closed position. In some embodiments, the linkage has an "over-center" design, in which more force is applied to the drive ring when the linkage is closer to parallel to the plane of the drive ring than when the linkage is further from parallel to the plane of the drive ring.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF EMBODIMENT(S)

One or more specific embodiments of the present disclosure will be described below. In an effort to provide a concise description of these embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
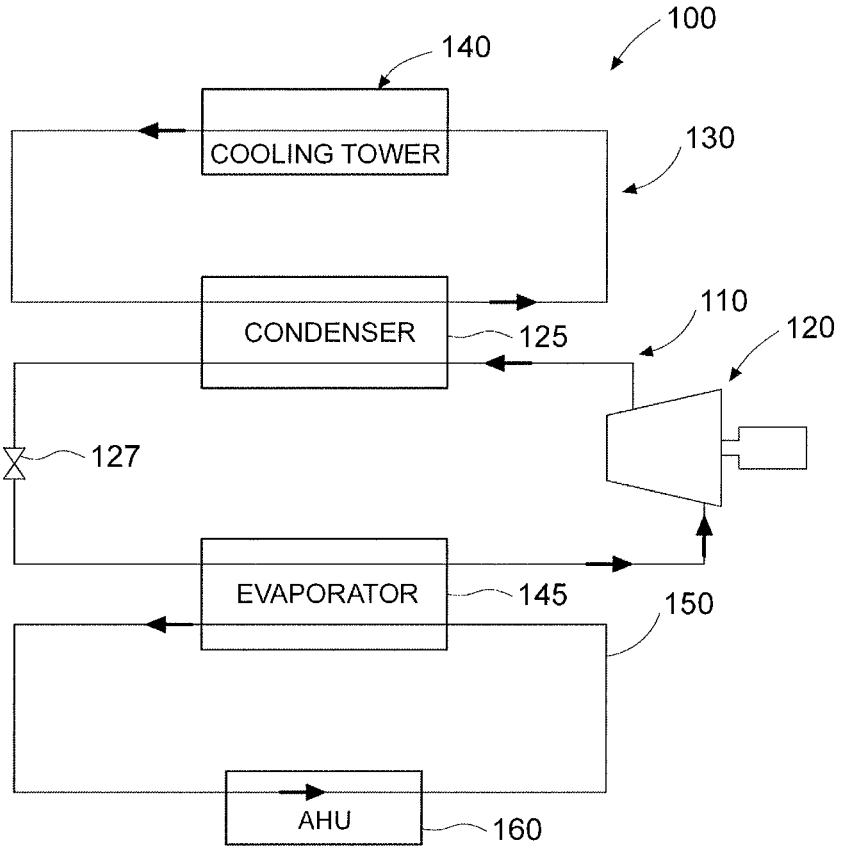
FIG. 1 illustrates schematically a chiller system for a building in accordance with one embodiment of the present disclosure.

Turning to the figures, FIG. 1 illustrates an overview of a chiller system 100. At the center of the chiller is a refrigeration loop 110. A compressor 120 converts a relatively cool low-pressure refrigerant gas into a hot high-pressure gas. That hot high-pressure gas then transitions into a high-pressure liquid refrigerant in the condenser 125. During this step, heat from the high-pressure gas is transferred to the water circulating in a cooling-water loop 130, often through a heat exchanger in the condenser 125. Ultimately, the heat transferred to the water in the cooling-water loop 130 is expelled to the outdoor environment via another heat exchanger in a cooling tower 140.

The now-liquid refrigerant leaving the condenser 125 in the refrigerant loop transitions into a low-pressure liquid when it passes through an expansion valve 127. This drop in pressure also reduces the temperature of the refrigerant as it becomes a low-pressure liquid. The cool low-pressure liquid then enters the evaporator 145 where heat is transferred back into the refrigerant, converting the refrigerant into back into a low-pressure gas to be compressed by the compressor. The heat transferred to the refrigerant in the evaporator 145 is provided by water circulating in a chilled-water loop 150, often through a heat exchanger in the evaporator 145. The chilled-water loop 150 carries the now-cooled water to air-handling units (AHUs) 160 that circulate the building's indoor air over a heat exchanger, to cool the indoor space. It is envisaged that the refrigerant could be any number of refrigerants, including R410A, R32, R454B, R452B, R1233zd, R1234ze, R134a, R513A, R515A, R515B, and R1234yf, or any number of combinations thereof.

Figure 2A:
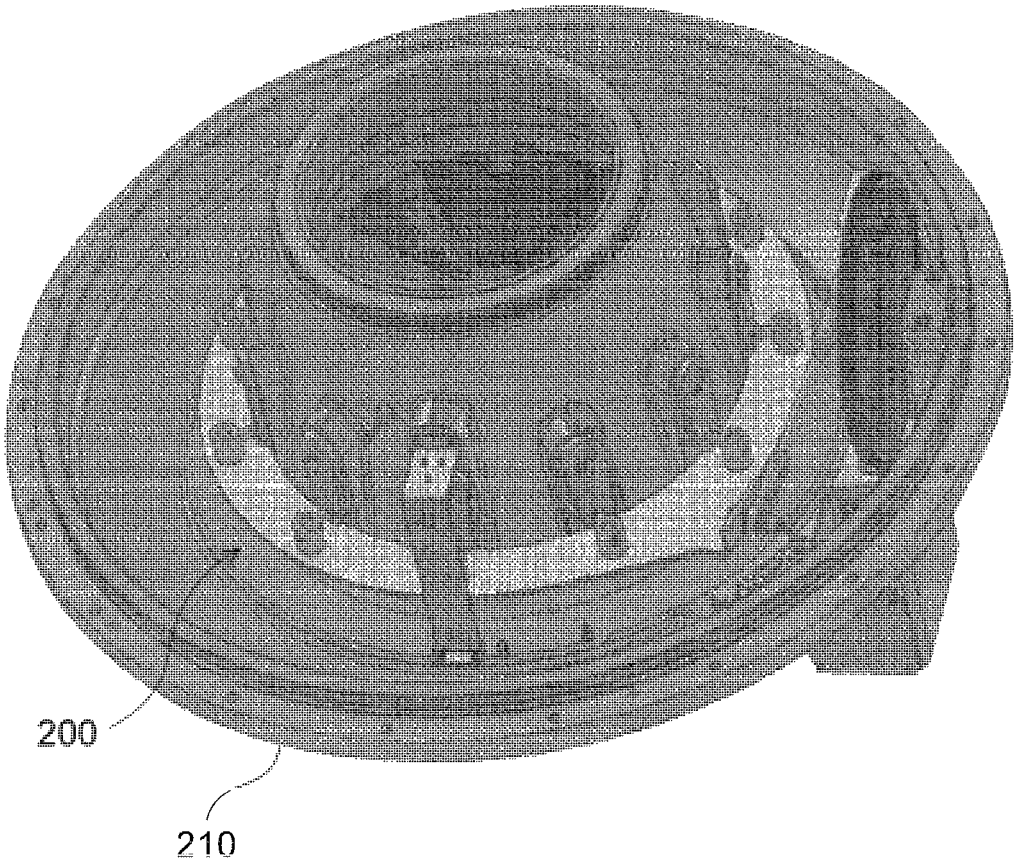
FIGS. 2A-2B illustrate schematically an IGV actuator assembly mounted within a portion of a centrifugal chiller in accordance with an embodiment of the present disclosure.
Figure 2B:
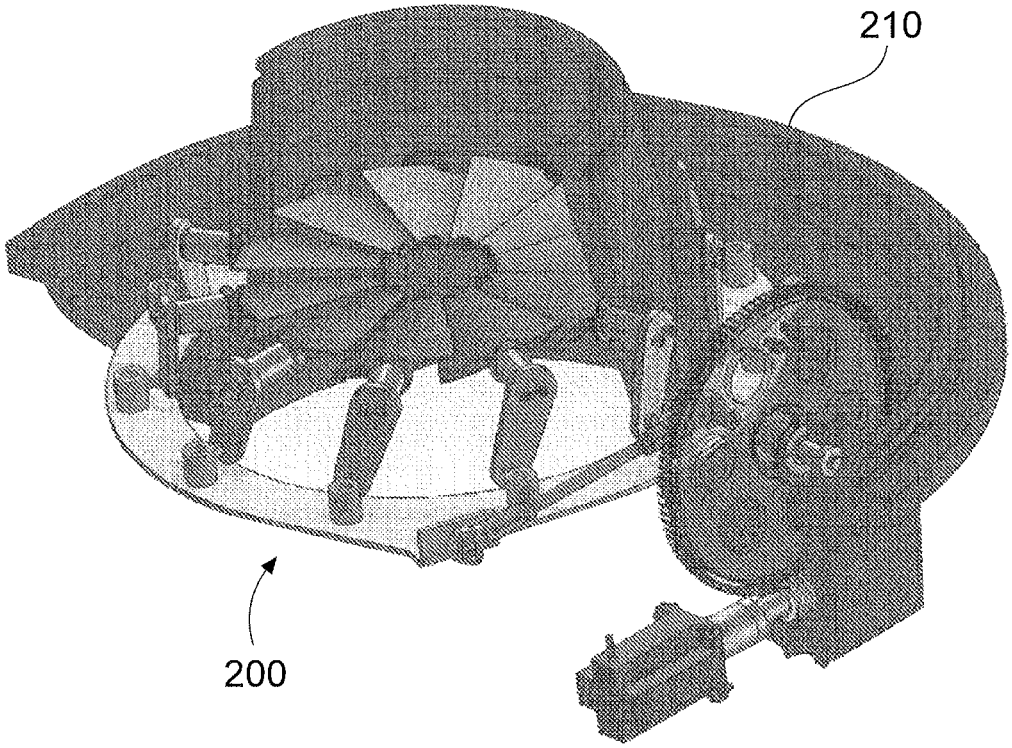

FIG. 2A illustrates schematically an IGV actuator assembly 200 installed within a portion of a centrifugal compressor 210. FIG. 2B illustrates schematically an IGV actuator assembly 200 installed within a centrifugal compressor 210 with a portion of the compressor removed in order to show the arrangement of one embodiment of the IGV actuator assembly 200 within the centrifugal compressor 210. IGVs of the IGV actuator assembly 200 direct the flow of gas within a centrifugal compressor 210 incorporated into a chiller system. In other words, IGVs of the IGV actuator assembly 200 impact the flow of gas within a centrifugal compressor 210 incorporated into a chiller system.

Centrifugal compressors operate by drawing a gas through inlet guide vanes and compressing the gas using a centrifugal impeller. The flow of gas entering the centrifugal compressor is regulated by the opening and closing of the IGVs.

Figure 3A:
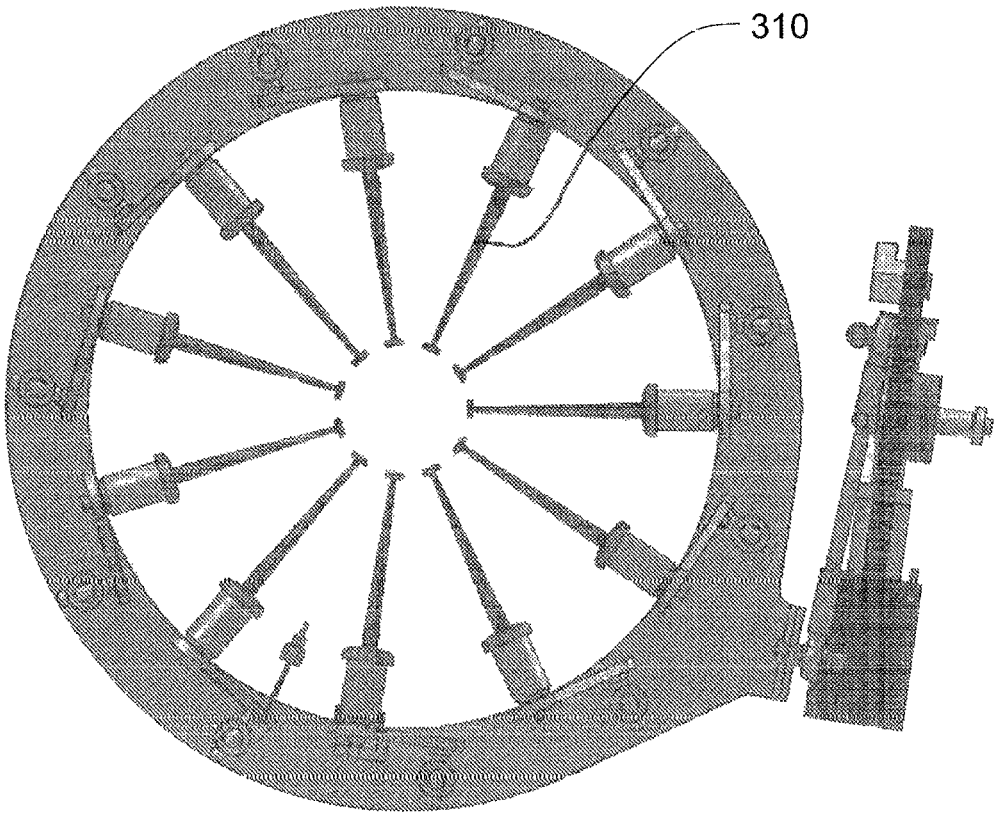
FIGS. 3A-3C illustrate schematically the opening and closing positions of IGVs in accordance with an embodiment of the present disclosure.
Figure 3B:
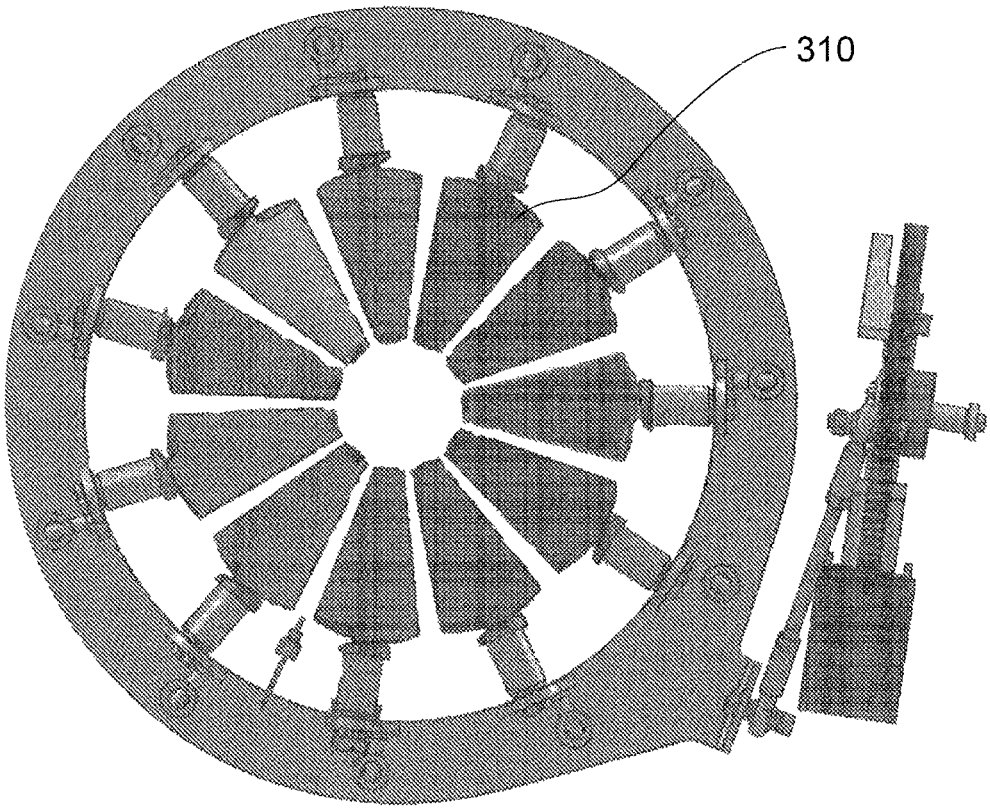
Figure 3C:
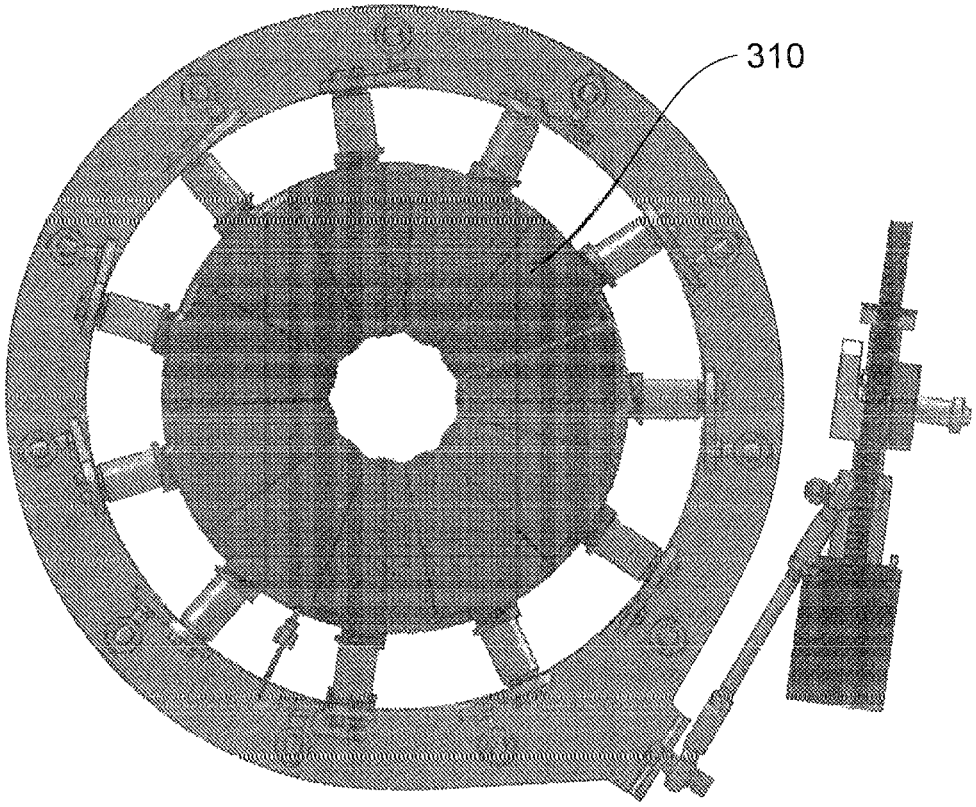

FIGS. 3A-C illustrate the IGVs 310 as they transition from the open position to the closed position. FIG. 3A illustrates the IGVs 310 in the fully open position. In this position, gas is allowed to flow through the vanes substantially unrestricted. FIG. 3B shows the IGVs 310 once they have rotated to a partially closed position. In this position, gas is allowed to flow through the vanes but is somewhat restricted. The vanes also serve to direct the flow of gas in order to facilitate the rotational motion of the gas entering the centrifugal compressor. FIG. 3C illustrates the IGVs 310 in the fully closed position. In this position, the flow of gas is significantly restricted. In some IGV assemblies, a center portion of the IGVs remains open in order to allow a minimum refrigerant flow even when the IGVs are in the closed position.

Figure 4:
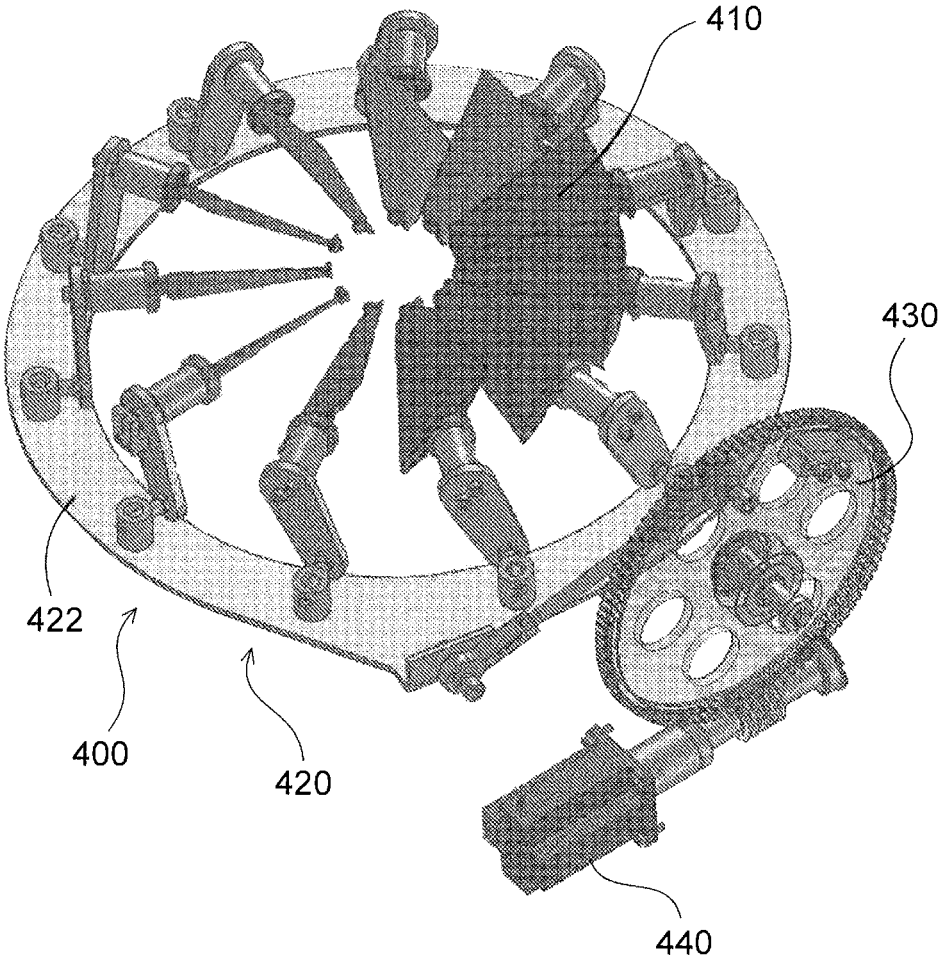
FIG. 4 illustrates schematically an IGV actuator assembly in accordance with an embodiment of the present disclosure.

FIG. 4 illustrates schematically an IGV actuator assembly 400 in accordance with one embodiment. As depicted, the assembly 400 allows for controlling the position of a plurality of IGVs 410. The plurality of IGVs 410 are opened and/or closed in a coordinated movement to restrict or expand the flow of fluid through the IGVs 410 into a centrifugal compressor.

In the disclosed assembly, the IGVs 410 are coupled to a drive structure 420 that controls the opening and closing of the IGVs 410. In some embodiments, the drive structure 420 includes a drive ring 422. In some embodiments, the drive structure 420 is connected to an actuation mechanism 430 that imparts a force to the drive structure 420, causing the IGVs 410 to open or close. The actuation mechanism 430 may impart a rotational force to the drive ring 422. The actuation mechanism 430 is driven by an actuator 440.

Figure 5:
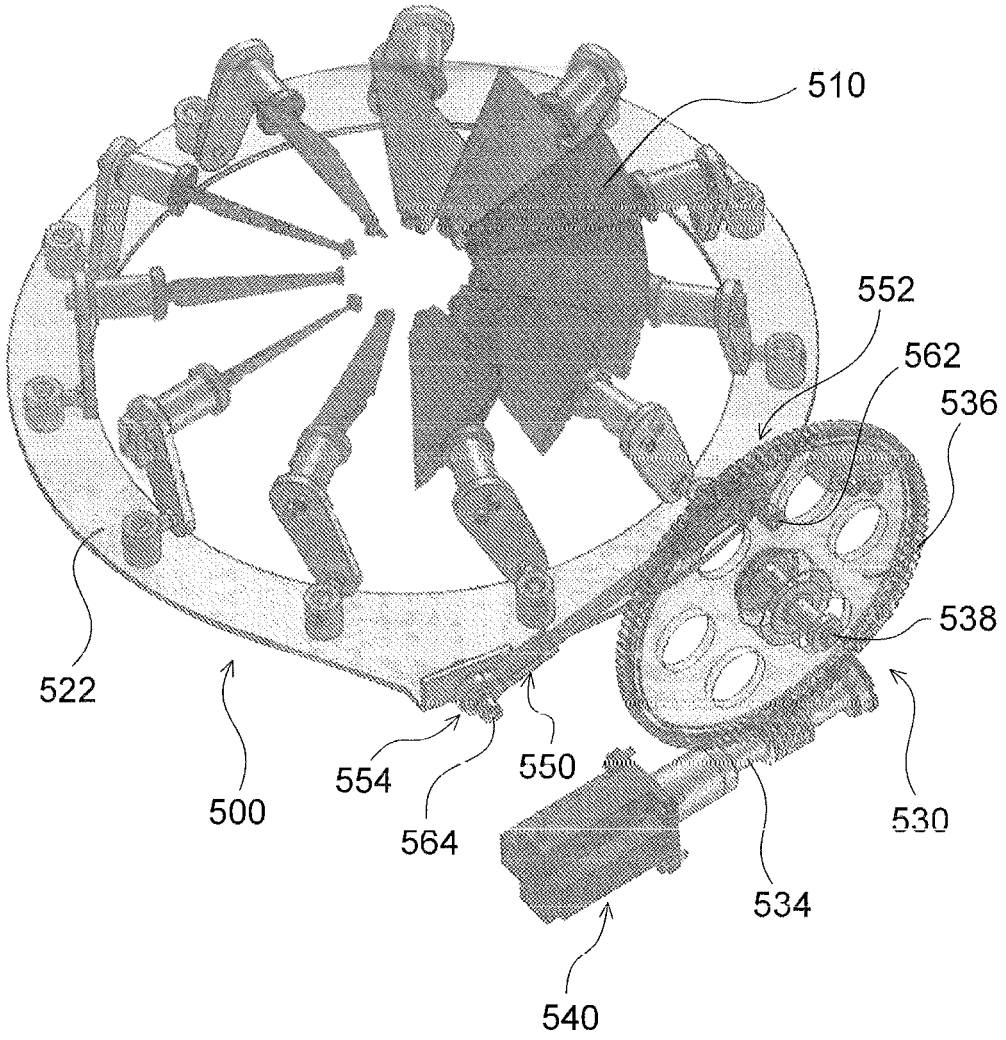
FIG. 5 illustrates schematically an IGV actuator assembly in accordance with an embodiment of the present disclosure.

FIG. 5 illustrates schematically an IGV actuator assembly 500 in accordance with one embodiment. In one disclosed embodiment, the IGV actuator assembly 500 is driven by a worm drive 530. The worm drive 530 includes a driven worm screw 534 that is used to rotate a worm gear 536 that is mounted on a central hub 538. The worm drive 530 is driven by a worm actuator 540. A linkage arm 550 is connected to the worm gear 536 at a first end 552 and to a drive ring 522 at a second end 554. (As used herein, "end" does not refer to a terminal position, it instead refers to a location more toward one side than another.) The point at which the linkage arm 550 is connected to the worm gear 536 is referred to as the first point 562. The point at which the linkage arm 550 is connected to the drive ring 522 is referred to as the second point 564.

As the worm screw 534 is driven, it causes the worm gear 536 to rotate. The rotation of the worm gear 536 transmits a force through the linkage arm 550 causing the drive ring 522 to rotate, thereby opening or closing the IGVs 510. That is, the drive ring 522 is operably connected to IGVs 510 and configured to rotate the IGVs 510 between an open position and a closed position. In other words, the drive ring 522 is operably connected to the IGVs 510 and configured to open and close IGVs 510.

In some embodiments, a mechanical advantage can be created based on the specific configuration of the worm gear, linkage arm, and drive ring. The linkage arm converts the rotation of the worm gear into rotation of the drive ring. In some embodiments, the worm gear and drive ring are positioned substantially perpendicularly with respect to each other. In other words, the worm drive includes the worm gear arranged substantially perpendicular to the drive ring. In some embodiments, the amount of rotation imparted to the drive ring per unit rotation of the worm gear depends on the position of the first point and/or the relative angle between the drive ring and the worm gear.

For example, when the first point is most perpendicularly offset from the plane defined by the drive ring (i.e., the first plane) each unit of rotation of the worm gear translates into a greater amount of travel of the first point in a direction parallel to the first plane, thereby causing the linkage arm to rotate the drive ring a greater amount but reducing the mechanical advantage of the linkage system. As the first point rotates with the worm gear and approaches the plane defined by the drive ring, each unit of rotation of the worm gear translates into a reduced amount of travel of the first point in a direction parallel to the first plane, thereby causing the linkage arm to rotate the drive ring a lesser amount but increasing the mechanical advantage of the linkage system. The result of this arrangement is that a greater amount of force may be applied to the drive ring when the first point is closer to the plane than when the first point if more offset from the first plane.

In some embodiments, the linkage arm generally defines a first line that intersects the first plane defined by the drive ring. In such embodiments, as the gear rotates, the acute angle formed between the first line and the first plane will increase or decrease. In some embodiments, the mechanical advantage is greater when the acute angle between the first line and first plane is smaller than when the acute angle is larger. In some embodiments, the acute angle between the first plane and the first line is smaller when the plurality of guide vanes are closed and larger when the plurality of guide vanes are open.

Figure 6A:
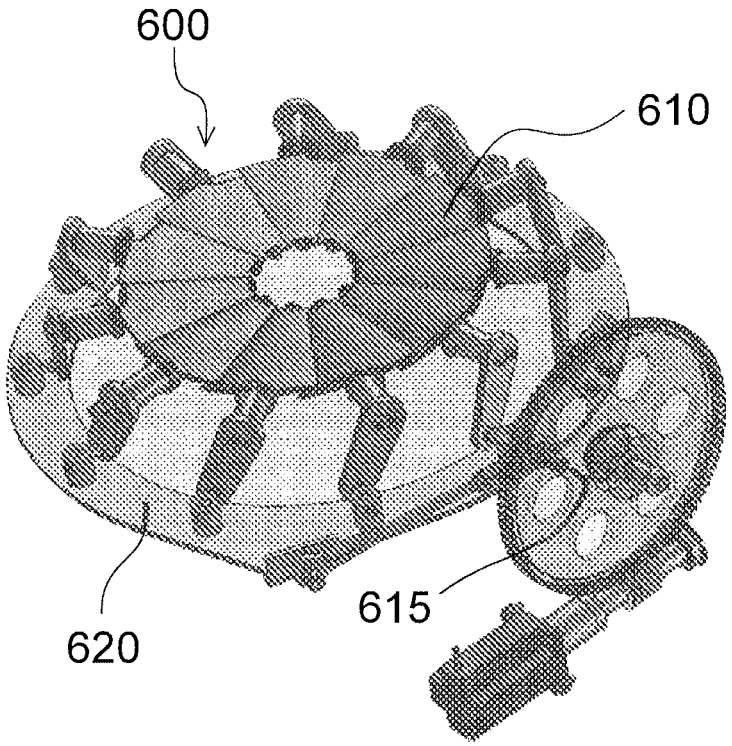
FIGS. 6A-6J illustrate schematically the operation of an IGV actuator assembly in accordance with an embodiment of the present disclosure.

FIGS. 6A-6J illustrate schematically the motion an IGV actuator assembly 600 in accordance with one embodiment. FIG. 6A shows the IGVs 610 in a substantially closed position. In this position, the gas passing though the IGVs 610 exerts the greatest force on the IGVs, creating a resistance to opening the IGVs. The first point 615 is substantially adjacent to the first plane 605 (see FIG. 6C), defined by the drive ring 620, thereby creating an increased mechanical advantage when the IGVs 610 are closed and are subject to the greatest amount of resistance from the flowing gas.

Figure 6B:
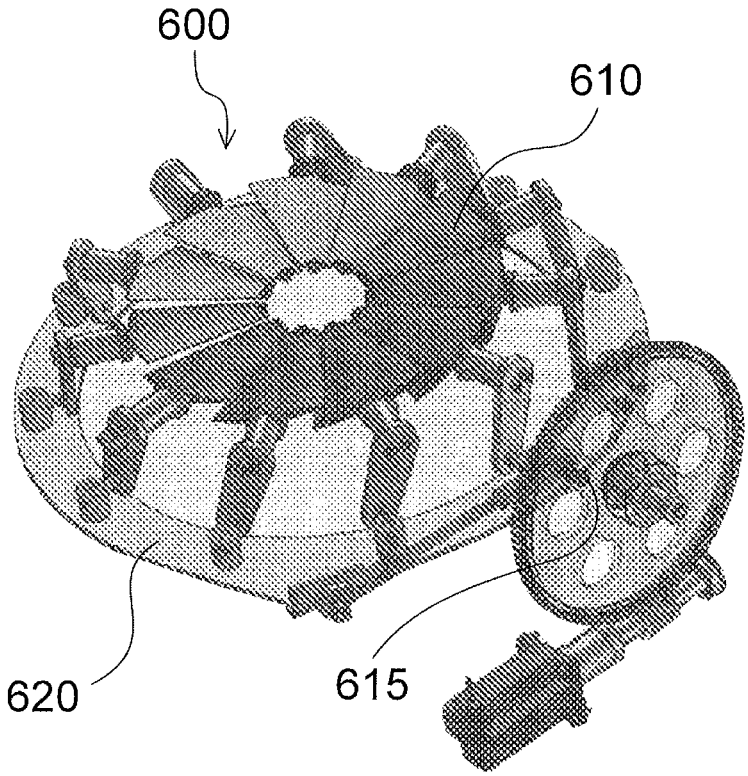

FIG. 6B shows the assembly 600 when the worm screw has rotated the worm gear approximately 10° clockwise. This rotation moves the first point 615 almost entirely in a direction perpendicular to the first plane, resulting in only minimal rotation of the drive ring and opening the IGVs 610 a small amount. It will be appreciated that the worm screw rotates substantially the same amount in order to rotate the circular worm gear 10° regardless of the position of the first point 615. However, the force applied by the linkage arm to the drive ring varies significantly depending on the position of the first point 615.

Figure 6C:
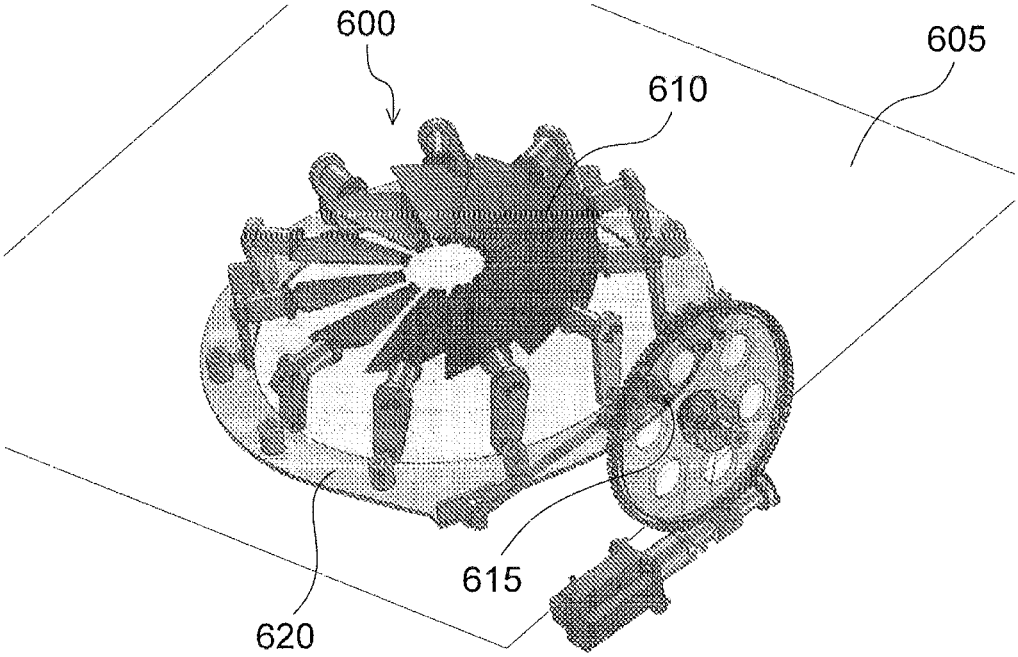
Figure 6D:
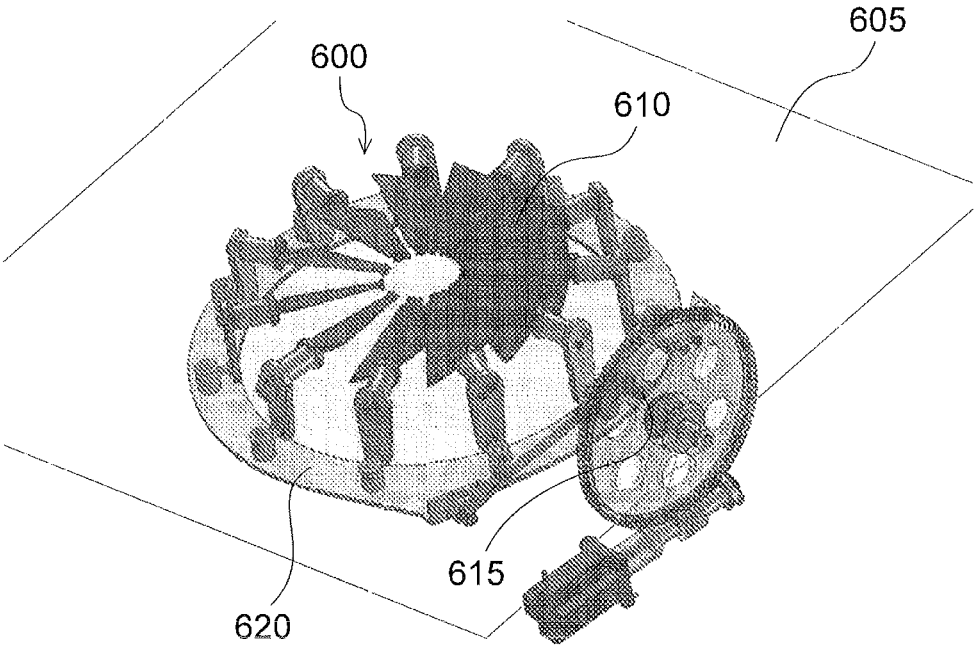
Figure 6E:
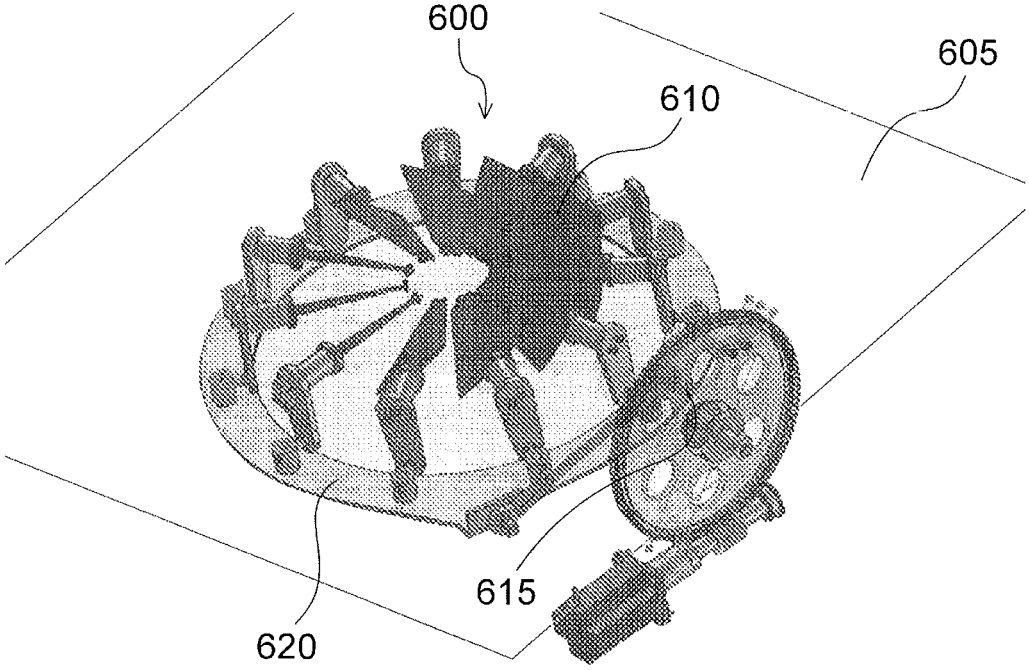
Figure 6F:
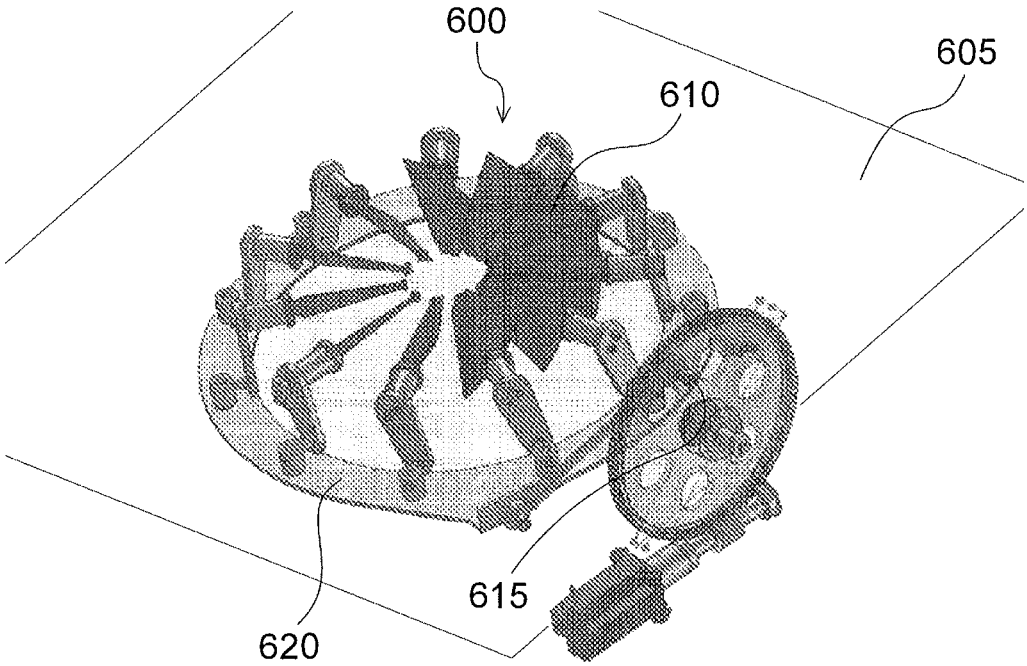
Figure 6G:
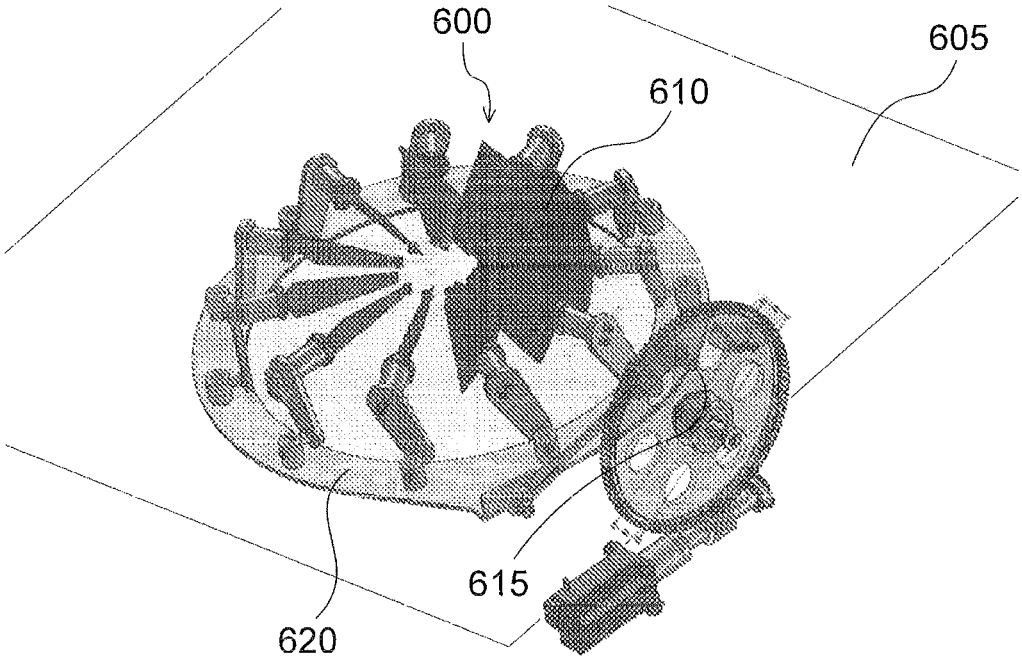
Figure 6H:
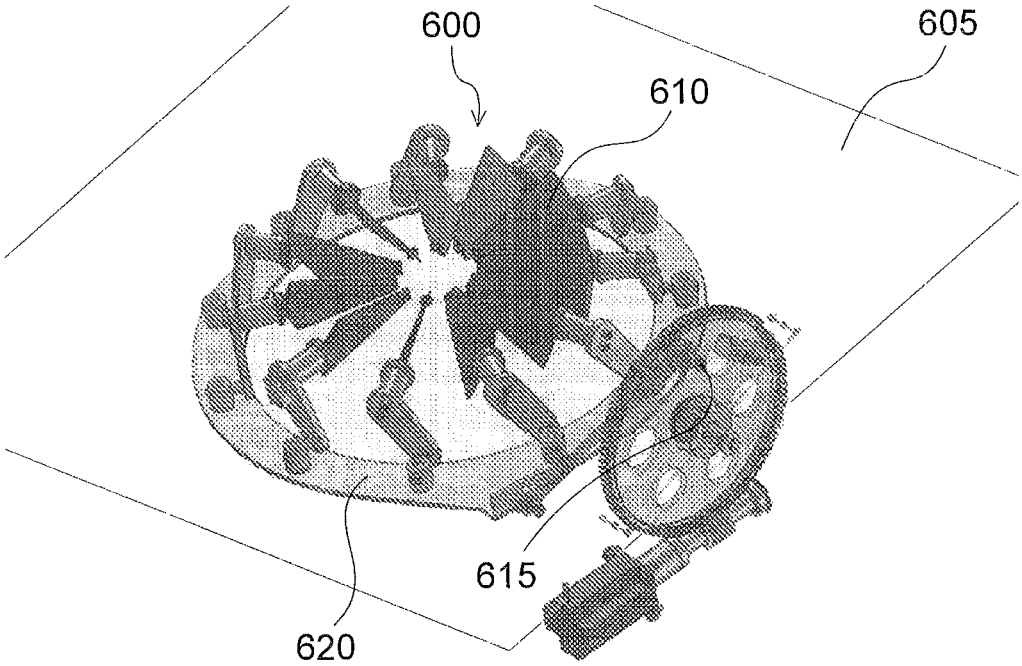

FIG. 6C though FIG. 6H show the assembly 600 as the worm screw rotates the worm gear clockwise approximately 10° more in each figure. In each figure, the first point 615 rotates clockwise with the worm gear. Although the worm gear rotates approximately 10° in each figure, the first point 615 travels in a direction more parallel and less perpendicular to the first plane 605 in each successive figure. This results in the linkage arm rotating the drive ring an increasing amount per 10° rotation from FIG. 6C to FIG. 6H, as the first point 615 rotates with the worm gear to a point further away from the first plane. As can be seen in the figures, the acute angle formed between the linkage arm and the first plane 605 increases with each 10° rotation.

Figure 6I:
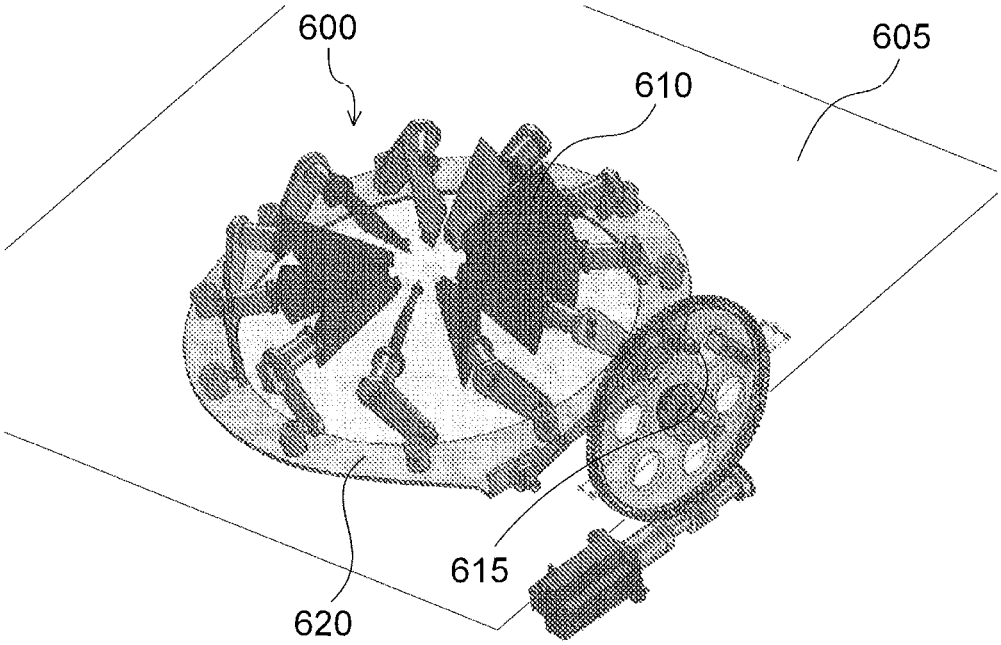

FIG. 6I shows the assembly 600 when the worm screw has rotated the worm gear approximately 80° and the first point is approaching being maximally offset from the first plane 605. In this position, each 10° rotation of the worm gear moves the first point 615 almost entirely in a direction parallel to the first plane 605 and therefore the linkage arm causes a significant rotation of the drive ring 620. The IGVs 610 are substantially open in this position allowing gas to enter the centrifugal compressor with relatively little resistance. As the flowing gas does not provide significant increased resistance when the assembly is in this configuration, the increased mechanical advantage created by the assembly is not required.

Figure 6J:
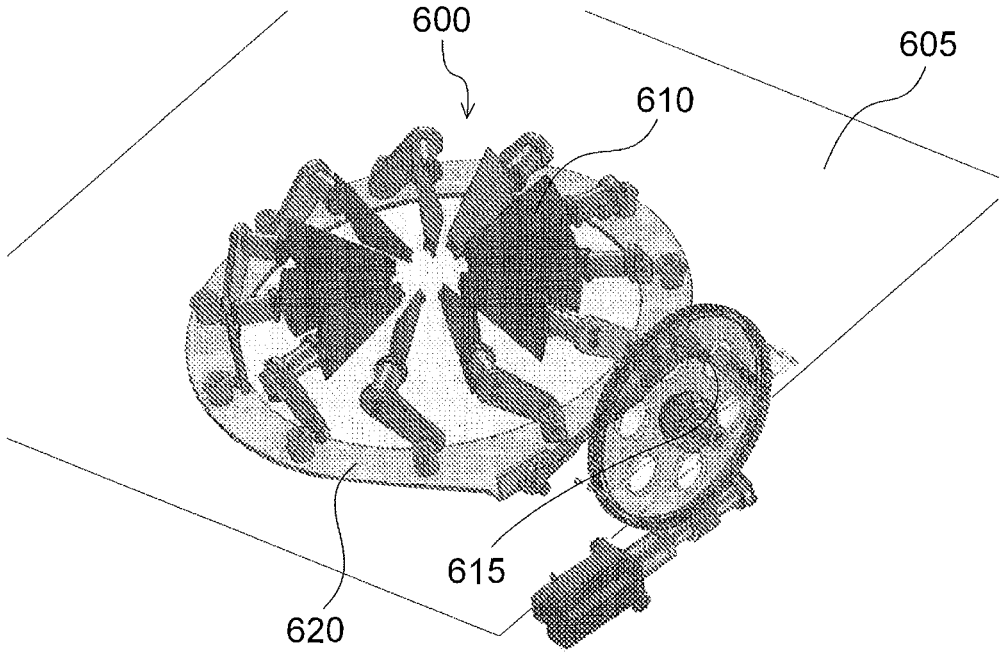

FIG. 6J shows the assembly 600 when the worm screw has rotated the worm gear approximately 90° from the configuration illustrated in FIG. 6A and the first point 615 is maximally offset from the first plan 605. The IGVs are fully open to allow gas to pass relatively freely into the centrifugal compressor. In this position, the flowing gas does not create a significant resistance to the movement of the IGVs 610. The mechanical advantage created by the assembly is minimized in this position.

Figure 7:
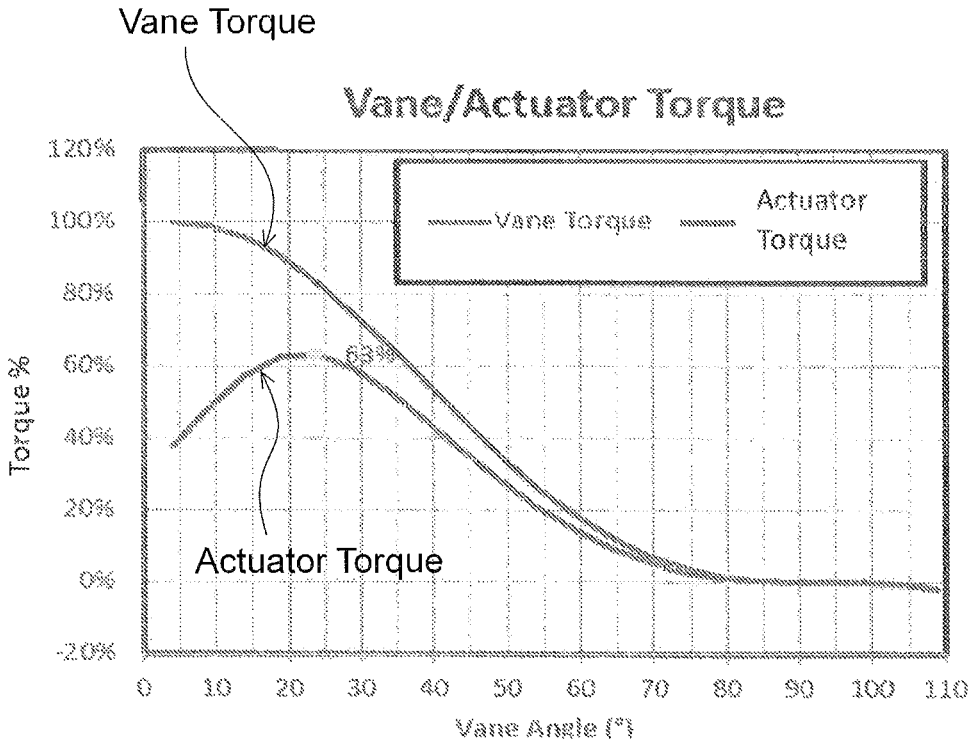
FIG. 7 illustrates the relationships between torque and vane angle in an IGV actuator assembly in accordance with an embodiment of the present disclosure.

FIG. 7 illustrates a graph showing the relationship between vane angle and actuator torque for an IGV actuator assembly in accordance with one embodiment. As shown in the graph, in some embodiments, vane torque peaks when the vanes are in the closed position and the vane angle approaches zero degrees. Due to the mechanical advantage created by the disclosed mechanism, the required actuator torque is reduced as the vane angle approaches zero despite the total vane torque increasing as the vane angle approaches zero. As you can see in FIG. 7, a difference between a torque created by the actuator and a torque applied to the guide vanes is increased as the angle of the guide vanes with respect to the drive ring decreases. Further, FIG. 7 indicates that an amount of force applied by the linkage arm to the drive ring is greater when the guide vanes are in the closed position than when the guide vanes are in the open position.

As illustrated by FIG. 7, in some embodiments, the actuation mechanism imparts a first amount of rotational force to drive the drive structure, which is translated into vane torque, when the guide vanes are in a first position and a second amount of rotational force when the guide vanes are in a second position. In some embodiments, the actuation mechanism provides a mechanical advantage to the actuator when the guide vanes are in the first positions as compared to when the guide vanes are in the second position.

While the general concept of the disclosed IGV actuator assembly has been discussed in the context of a few particular embodiments, it will be appreciated that many variations are contemplated.

Disclosed embodiments include a plurality of guide vanes, a drive structure, and an actuation mechanism. In some embodiments, the drive structure includes a drive ring or any other suitable structure capable of receiving a force from the actuation mechanism and adjusting the position of the plurality of guide vanes.

In some embodiments, the actuator mechanism may include a worm drive, pully drive, belt drive, or rack-and-pinion. In some embodiments, the actuator mechanism includes a gear which may be, for example, a spur gear, worm gear, helical gear, bevel gear, wheel, or any suitable component configured to receive an actuating force and imparting a force, such as a rotational force, to the drive structure or drive ring. In some embodiments, the gear is mounted on a central hub. In some embodiments, the gear is arranged, substantially perpendicular to the drive structure or drive ring. In some embodiments, the gear is arranged at a greater than 45° angle to the drive structure or drive ring. In some embodiments the gear is elliptical. In some embodiments, the actuator mechanism includes multiple gear which may be engaged with each other and/or rotationally linked by a hub.

In some embodiments, the actuator mechanism includes a linkage arm. In some embodiments, the linkage arm has a first and second end with the first end connected to a gear or wheel at a first point and the second end connected to the drive structure or drive ring at a second point. In some embodiments, the linkage arm transmits force from the gear or wheel of the actuator mechanism to the drive structure or drive ring. In some embodiments, the linkage arm includes one or more hinged or pivoting attachment points arrange to accommodate the motions of both the actuator assembly and the drive structure. In some embodiments, the motion of the drive ring forms an arc. In such embodiments, the second point moves in the motion of the arc and also rotates with the drive ring. The linkage arm must accommodate each of these motions while also maintaining a rotating connection with the gear at the first point. In some embodiments, the linkage arm is arranged to provide both a pulling and a pushing force. In some embodiments, more than one linkage arm may be used. In such embodiments, each linkage arm may be arranged to provide either a pushing or pulling force.

In some embodiments, the actuator mechanism is driven by an actuator. The actuator may be an electric actuator, pneumatic actuator, hydraulic actuator, magnetic actuator, or a motor. In some embodiments, the actuator engages the gear using a worm screw, rack, chain drive, and/or belt drive. In some embodiments, the actuator engages the gear through an intermediate mechanism such as, for example, a series of gears or a central huh.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

REFERENCE SIGNS LIST

200: IGV actuator assembly
310: IGVs
400: IGV actuator assembly
410: IGVs
420: drive structure
422: drive ring
430: actuation mechanism
440: actuator
500: IGV actuator assembly
510: IGVs
522: drive ring
530: worm drive
534: driven worm screw
536: worm gear
538: central hub
540: worm actuator
550: linkage arm
552: first end
554: second end
562: first point
564: second point
600: assembly
605: first plane
610: IGVs
615: first point
620: drive ring

What is claimed is:

1. An inlet guide vane assembly for a centrifugal compressor, the inlet guide vane assembly comprising:

a plurality of guide vanes;

a drive structure coupled to the plurality of guide vanes, the drive structure being configured such that rotation of the drive structure transitions the plurality of guide vanes from a first position to a second position, the drive structure including a drive ring;

an actuator; and an actuation mechanism configured to cause the drive structure to transition the plurality of guide vanes between the first and second positions based on operation of the actuator, the actuation mechanism including a gear operatively connected to the actuator and a linkage that is pivotally coupled between the gear and the drive ring and is movable with respect to the drive ring and the gear, with the drive ring, the gear and the linkage being independently formed as separate members, the actuation mechanism being configured to impart a first amount of rotational force to drive the drive structure when the guide vanes are in the first position and a second amount of rotational force when the guide vanes arc in the second position, and the actuation mechanism being configured to provide a mechanical advantage to the actuator when the guide vanes are in the first positions as compared to when the guide vanes are in the second position.

2. The inlet guide vane assembly of claim 1, wherein the actuation mechanism includes a worm drive.

3. The inlet guide vane assembly of claim 1, wherein the gear is elliptical.

4. The inlet guide vane assembly of claim 1, wherein the mechanical advantage is greatest when the guide vanes are in closed position.

5. The inlet guide vane assembly of claim 1, wherein the actuation mechanism is configured to impart a rotational force to the drive ring.

6. The inlet guide vane assembly of claim 1, wherein the gear is arranged perpendicular to the drive ring.

7. The inlet guide vane assembly of claim 1, wherein a difference between a torque created by the actuator and a torque applied to the guide vanes is increased as an angle of the guide vanes with respect to the drive ring decreases.

8. An inlet guide vane assembly for a centrifugal compressor, the inlet guide vane assembly comprising:

a worm drive including a worm actuator and a worm gear mounted on a hub;

a drive ring defining a first plane, the drive ring being operably connected to a plurality of guide vanes and configured to rotate the guide vanes between an open position and a closed position; and a linkage arm haying a first end connected to the worm gear at a first point and a second end connected to the drive ring at a second point, the first point being closer to the first plane when the guide vanes are in the closed position than when the guide vanes are in the open position.

9. The inlet guide vane assembly of claim 8, wherein the inlet guide vanes are configured to direct a flow of gas within the centrifugal compressor, and the centrifugal compressor is configured to be incorporated into a chiller system.

10. The inlet guide vane assembly of claim 9, wherein the chiller system includes a refrigerant at least partially including a refrigerant selected from the group consisting of R410A, R32, R454B, DR-55, HFO-1234ze, R134a, R513A, R515A, R515B, and HFO-1234yf.

11. The inlet guide vane assembly of claim 8, wherein an amount of force applied by the linkage ann to the drive ring is greater when the guide vanes are in the closed position than when the guide vanes are in the open position.

12. An inlet guide vane assembly for a centrifugal compressor, the inlet guide vane assembly comprising:

a worm drive including a worm actuator and a worm gear mounted on a central hub;

a drive ring defining a first plane, the drive ring being operably connected to a plurality of guide vanes and configured to open and close the plurality of guide vanes; and a linkage arm defining a first line and having a first end connected to the worm gear and a second end connected to the drive ring, an acute angle between the first plane and the first line is smaller when the plurality of guide vanes are closed than when the plurality of guide vanes are open.

13. The inlet guide vane assembly of claim 12, wherein the inlet guide vanes are configured to impact a flow of gas within the centrifugal compressor, and the centrifugal compressor is configured to be incorporated into a chiller system.

14. The inlet guide vane assembly of claim 13, wherein the chiller system includes a refrigerant at least partially including a refrigerant selected from the group consisting of R410A, R32, R454B, DR-55, HFO-1234ze, R134a, R513A, R515A, R515B, and HFO-1234yf.

15. The inlet guide vane assembly of claim 12, wherein an amount of force applied by the linkage arm to the drive ring is greater when the acute angle is smaller than when the acute angle is larger.

* * * * *